US005168808A

United States Patent [19]

Prem

[11] Patent Number: 5,168,808

[45] Date of Patent: Dec. 8, 1992

[54] SLEEVED PRINTING MACHINE ROLLER OR CYLINDER FOR AN OFFSET PRINTING MACHINE, AND METHOD OF SLEEVING A CYLINDER CORE

[75] Inventor: Wolfgang Prem, Ustersbach, Fed. Rep. of Germany

[73] Assignee: Man Roland Druckmaschinen AG, Augsburg, Fed. Rep. of Germany

[21] Appl. No.: 823,303

[22] Filed: Jan. 21, 1992

[30] Foreign Application Priority Data

Feb. 27, 1991 [DE] Fed. Rep. of Germany ..... 4106062

[51] Int. Cl.[5] ..... B41F 13/10

[52] U.S. Cl. ..... 101/375; 101/479; 101/483

[58] Field of Search ..... 101/375, 376, 378, 415.1, 101/389.1, 382.1, 479, 483; 100/163 A, 163 R, 170; 279/2 A; 29/113.1

[56] References Cited

U.S. PATENT DOCUMENTS

| | | | |
|---|---|---|---|
| 3,253,323 | 5/1966 | Saueressig | 101/376 |
| 3,295,188 | 1/1967 | Saueressig | 101/376 |
| 4,144,812 | 3/1979 | Julian | 101/375 |
| 4,327,467 | 5/1982 | Quaint | 29/113.1 |
| 4,381,709 | 5/1983 | Katz | 101/375 |
| 4,383,483 | 5/1983 | Moss | 101/375 |
| 4,386,566 | 6/1983 | Moss | 101/375 |
| 4,641,411 | 2/1987 | Meulen | 101/375 |
| 4,651,643 | 5/1987 | Katz et al. | 101/375 |
| 4,656,942 | 4/1987 | Vertegaal | 101/493 |
| 4,685,393 | 8/1987 | Saueressig | 101/375 |
| 4,903,597 | 2/1990 | Hoage | 29/113.1 |
| 4,913,048 | 4/1990 | Tittgemeyer | 101/141 |
| 4,917,013 | 4/1990 | Katz | 101/375 |
| 4,934,266 | 6/1990 | Fantoni | 101/375 |

*Primary Examiner*—Clifford D. Crowder
*Assistant Examiner*—J. R. Keating
*Attorney, Agent, or Firm*—Frishauf, Holtz, Goodman & Woodward

[57] ABSTRACT

To securely attach a printing cylinder sleeve (3, 16, 28, 38, 38') over a cylinder core structure (2, 15, 27, 37), the core structure has grooves (4, 23, 29) located in the vicinity of axially remote end regions, which grooves are closed off by expansion rings (12, 25, 35, 38, 38'), which can be expanded by applying a hydraulic or pneumatic pressure medium, such as grease, or compressed air, between the core structure and the expansion ring. Connecting ducts, filled with grease, or connectable to a source of air pressure, are formed in the cylinder, connecting with the grooves therein.

13 Claims, 4 Drawing Sheets

SLEEVED PRINTING MACHINE ROLLER OR CYLINDER FOR AN OFFSET PRINTING MACHINE, AND METHOD OF SLEEVING A CYLINDER CORE

Reference to related patent, the disclosure of which is hereby incorporated by reference: U.S. Pat. No. 4,913,048, Tittgemeyer.

FIELD OF THE INVENTION

The present invention relates to a printing machine cylinder or roller, particularly for a rotary offset printing machine, in which a cylinder structure, for example a cylinder core, has a printing cylinder applied thereto, in which the printing cylinder is in the form of a sleeve, and the sleeve is retained on the cylinder by increasing, selectively, the diameter of the cylinder, or cylinder core, by a pressure medium, and to a method of applying the sleeve on the core.

BACKGROUND

The referenced U.S. Pat. No. 4,913,048, Tittgemeyer, the disclosure of which is hereby incorporated by reference, illustrates a printing roller or cylinder of the type to which the present invention relates. A sleeve-like cylinder is expanded by compressed air, so that it can then be pushed on a cylinder core, or a cylinder rotary structure. The core need not be a solid core but, itself, can be hollow and furnished with shaft ends or a through-shaft for retention in suitable bearings of the side wall of the printing machine. In accordance with the Tittgemeyer patent, the sleeve is expanded only to the extent that, after venting the compressed air, the sleeve engages the core or core structure similar to a shrink fit. Alternatively the cylinder sleeve is heated so that it will expand, slipped over the surface of the core structure, and cooled so that, again, a shrink fit will result. The sleeve thus is engaged by frictional engagement and stressed engagement on the core or core structure of the printing cylinder.

The sleeve, as well as the core, may be made largely of steel. Thus, the thermal coefficient of expansion of the core as well as of the sleeve will be the same. The sleeve, thus, cannot separate from the core in operation of the printing machine, since the increase in temperature will be essentially uniform both for the sleeve as well as for the core structure, or at least the surrounding surface, as the machine operates. Cylinder sleeves made of aluminum, however, have found wide acceptance. They have advantages, for example due to lesser environmental damage or pollution in their manufacture, with respect to cylinder sleeves made of steel. Aluminum, however, has a thermal coefficient of expansion which is about twice that of steel, and it has been found that, in operation, an aluminum sleeve may separate from the steel core when in printing operation. It is hardly possible, for manufacturing and assembly reasons, to manufacture a cylinder sleeve which is slightly undersized with respect to the steel cylinder, and expand such a sleeve sufficiently to permit it to be fitted over a steel cylinder core.

It has been proposed, see for example also the referenced Tittgemeyer U.S. Pat. No. 4,913,048, to increase the diameter of the core by a hydraulic system in order to ensure tight frictional fit of the cylinder sleeve on the core structure, after the cylinder sleeve has been mounted on the core structure.

It has been found, in actual operation, that it is difficult to increase the diameter of the surface of the cylinder core, due to problems with pressure application, sealing, and the like. Additional sealing problems arise. If printing media, for example damping fluids such as damping water, ink or solvents or other cleaning fluids penetrate between the printing cylinder sleeve and the cylinder core, cohesion forces may result which will cause the printing cylinder to adhere on the core by suction. It then becomes practically impossible to remove the printing cylinder sleeve without damage thereto or, usually, complete destruction thereof.

THE INVENTION

It is an object to provide a sleeved printing machine roller or cylinder, in which a cylinder core structure is so built that, upon increasing the diameter of the core structure, a cylinder sleeve is frictionally reliably retained during operation, while maintaining the combination cylinder sleeve—cylinder core sealed with respect to printing media, and in which the image transferred is not degraded by pressurizing the core to increase its diameter.

Briefly, only selected circumferential regions of the core structure are enlarged to thereby clamp the cylinder sleeve on the core structure. The enlarging arrangement includes at least two expansion rings which are located on the cylinder core structure and have outer surfaces facing the inner surface of the sleeve. The expansion rings are subjected, from the interior of the core structure, to expanding pressure, to deform the expansion rings and thereby retain the cylinder sleeve in position. The pressure can be applied, for example, by filling a channel with pressure transferring hydrocarbon, for example a grease, similar to axle grease, and pressurizing the grease in the duct, for example by tightening a closing screw into a duct. Thus, selectively, pressure is applied between the expansion rings, the core structure of the cylinder, and the sleeve, so that the rings are expanded and clamp the sleeve on the cylinder. The expansion rings need extend only over a portion across the axial length of the cylinder core structure, and leave other portions of the cylinder core structure undeformed.

DRAWINGS

DETAILED DESCRIPTION

Figure 1:
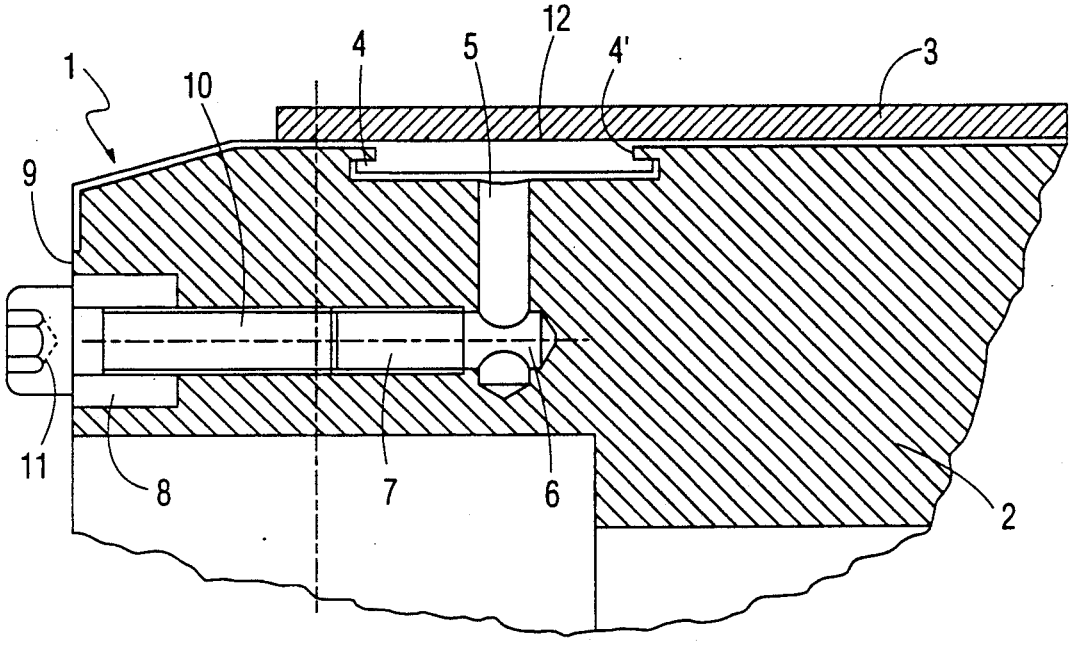
FIG. 1 is a fragmentary longitudinal sectional view through a printing machine cylinder on which a sleeve has been applied.
Figure 2:
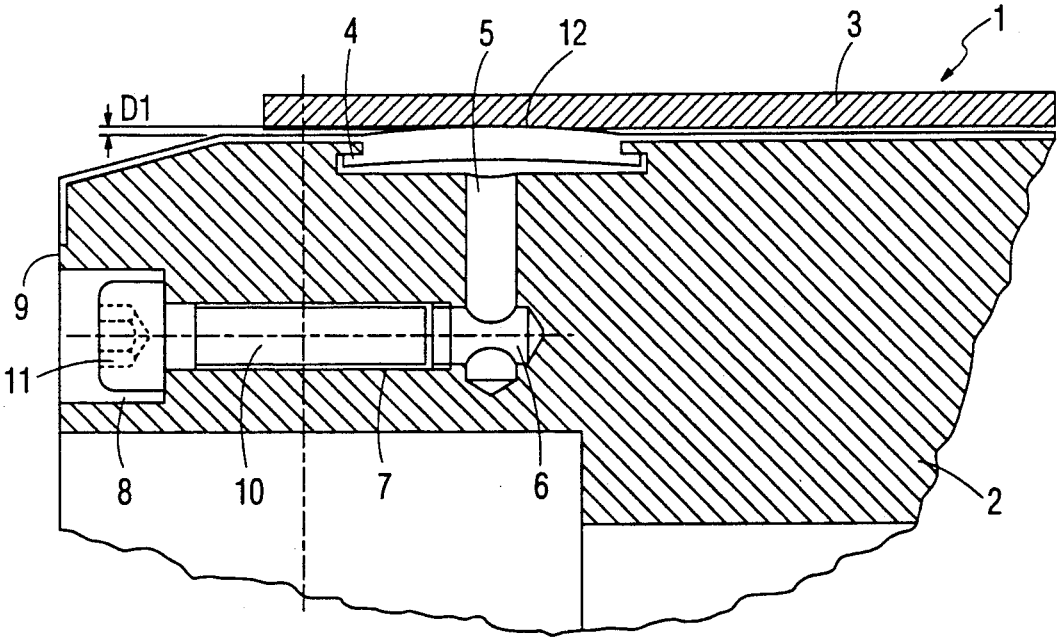
FIG. 2 is an enlarged fragmentary view of the end section of FIG. 1, illustrating details thereof, when pressure is applied.

Referring first to FIGS. 1 and 2:

The composite printing cylinder 1 has a cylinder core 2 which, as is customary, is a hollow cylindrical body. A sleeve printing cylinder 3 is pushed over the core 2. The wall thickness of the sleeve 3 is very small in comparison to that of the core cylinder 2.

In accordance with a feature of the present invention, a groove 4, having undercut groove edges 4', is formed in the surface of the core 2. The groove 4 is located in a region in the vicinity of the edge of the cylinder sleeve 3. A pressure supply duct or channel 6 has an end portion 5 which terminates in the groove 4. The other portion 7 of the duct 6 terminates in a recess 8 at the side wall 9 of the core 2. A screw element 10 can be screwed, by a suitable thread formed in the duct portion 7. The screw element 10 has a head 11, fitting into the recess 8, the head 11 sealing the duct 6 towards the outside.

An expansion ring 12, for example made of thermoplastic material, is fitted into the groove 4. The ring 12 covers the end 5 of the duct 6 towards the outside and, itself, is retained in the groove 4, for example by an interlocking fit with the undercut edge 4' of the groove 4. The duct 6 is filled with a hydraulic pressure substance, in the present case with grease or a highly viscous fluid.

Only one end portion of the entire printing roller or cylinder 1 is shown in FIG. 1. The other side is mirror-symmetrical, and has the same characteristics as the ones described in detail. This is also true for the embodiments described in connection with FIGS. 3–6. FIG. 2 illustrates the arrangement of FIG. 1, when the grease in the duct has been pressurized. The expansion ring 12 has been deformed; the screw 10 has been screwed into the end 7 of the duct 6. This compresses the hydraulic pressure substance in the duct, which, in turn, transfers the presssure to the deformable expansion ring 12. By deformation, the expansion ring 12 will, effectively, increase the diameter of the core cylinder 2 beneath the end region of the cylinder 3 by the amount D1. The diameter of the core structure 2, however, remains the same in the intermediate printing zone 13 (see FIG. 7). The expansion ring 12 provides for frictional retention of the sleeve 3 on the core 2 and, simultaneously, seals the sleeve 3 and the core 2 with respect to substances used in printing, such as ink, damping fluid, cleaning substances, solvents and the like.

The increase in diameter D1 can be controlled by selective screwing-in and screwing-out of the screw 10, thus changing the volume within the duct 6 and the adjacent region immediately beneath the expansion ring 12.

Figure 3:
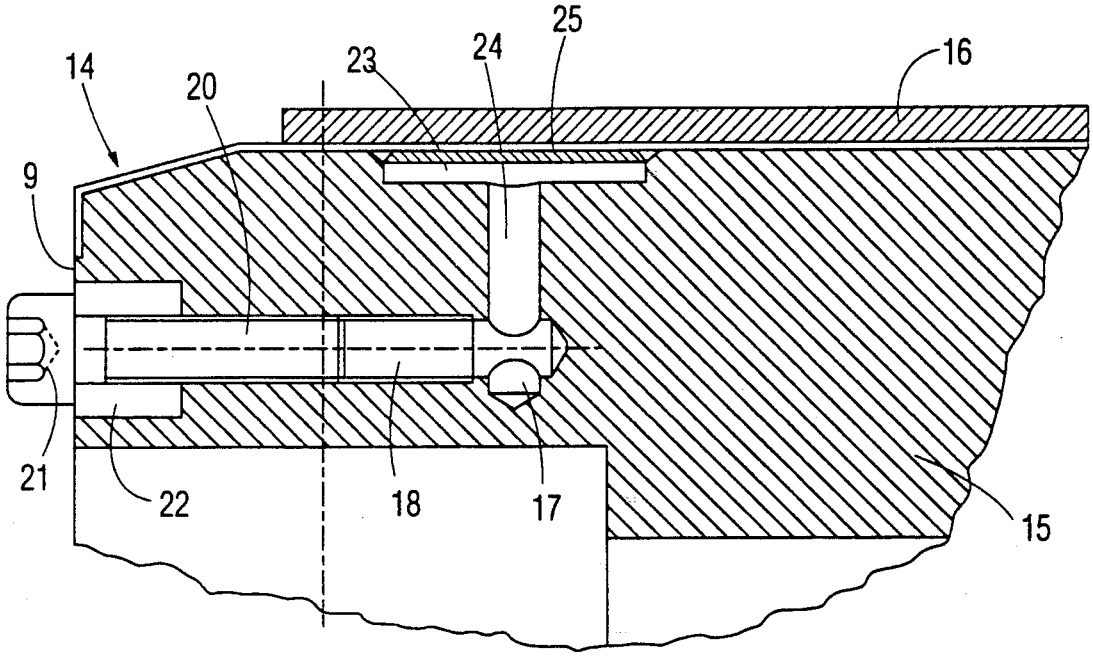
FIG. 3 is a view similar to FIG. 1, illustrating another embodiment.

FIG. 3 illustrates another embodiment of the present invention. The printing cylinder 14 has a core structure 15, a printing cylinder 16, and a supply duct 17, having one end 18 which is closed off adjacent the wall 19 of the core 15 by a screw element 20. The screw element 20 has a head 21 which fits into a recess bore 22, and is sealed towards the outside. As described in connection with the embodiments of FIGS. 1 and 2, a groove 23 is formed in the surface of the core 15 facing the sleeve 16. The other end 24 of the supply duct 17 terminates in the groove 23. An expansion ring 25 is fitted in the groove. The expansion ring, in accordance with a feature of the invention, is a ring-shaped sheet-metal element, which is welded to the edges of the groove 23. It is so fitted into the groove that the surface of the core 15, throughout, is smooth. The thickness of the sheet-metal ring 25 is slightly less than the depth of the groove 23, so that the entire underside of the groove 23 can be subjected to a pressure medium, for example grease.

Figure 4:
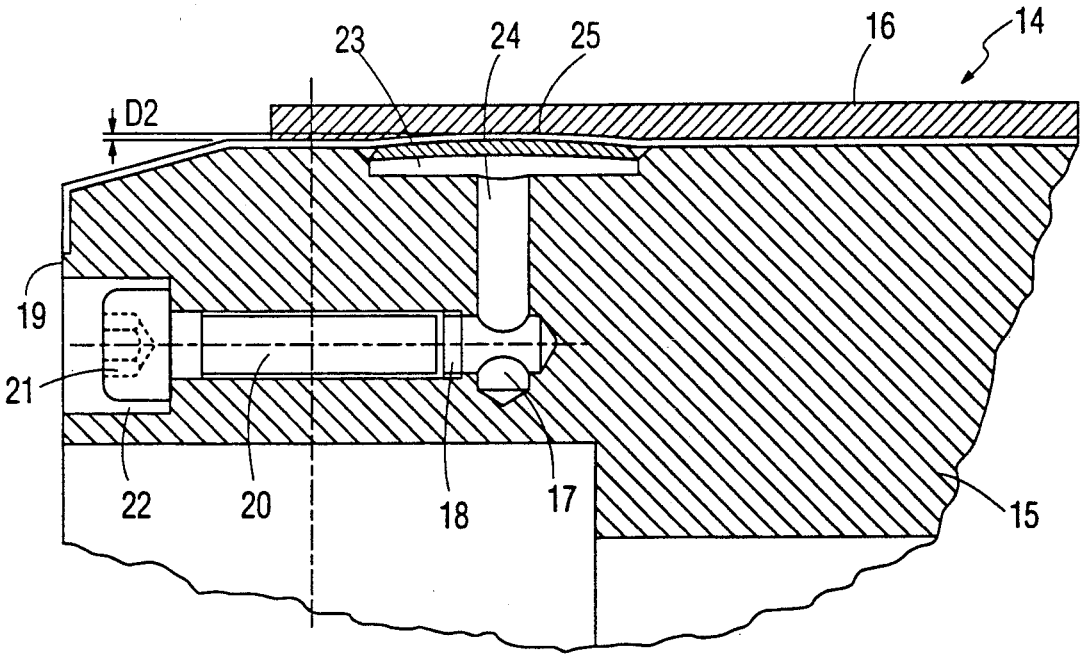
FIG. 4 is a view similar to FIG. 2, illustrating the embodiment of FIG. 3, when pressure has been applied.

FIG. 4 illustrates the embodiment of FIG. 3, however with the pressure medium compressed. The screw element 20 has been introduced more deeply into the duct 17, and the head 21 is within the recess 22 formed in the facing end surface 19 of the core 15. The expansion ring 25, subjected to the compressed pressure medium, will increase in diameter and, similarly to the embodiment described in connection with FIGS. 1 and 2, partially increases the diameter of the core 15 by the amount D2. Thus, the printing sleeve is frictionally retained on the core 15, while the printing sleeve 16 is sealed on the core with respect to ingress of contaminants which might collect between the sleeve 16 and the core 15. The amount D2 of the increase in diameter can be adjusted by selectively more or less screwing in the screw element 20.

Figure 5:
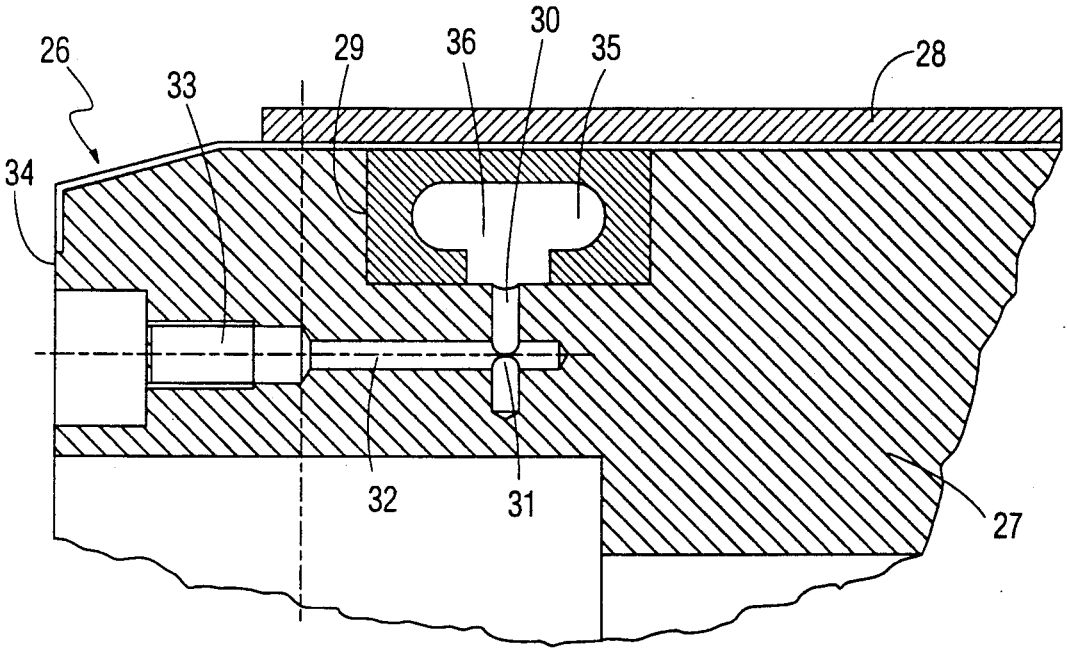
FIG. 5 is a view similar to FIG. 1, illustrating another embodiment.
Figure 6:
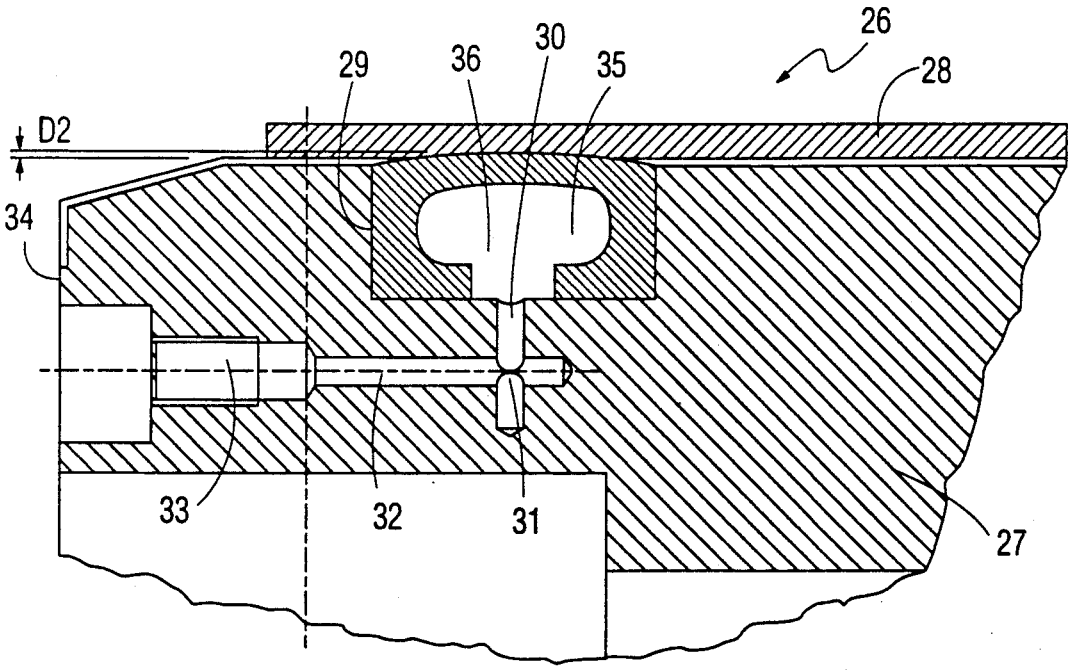
FIG. 6 is a view similar to FIG. 5, illustrating the embodiment of FIG. 5, when pressure has been applied.

FIG. 5 illustrates another embodiment in which the cylinder 26 has a core 27 on which a sleeve 28 is fitted, surrounding the core 27. In accordance with a feature of the invention, a groove 29 is cut into the surface of the core 27 facing the sleeve cylinder 28, located adjacent an end or face region of the core 27. A pressure medium supply duct 31 has an end portion 30 which terminates in the groove 29. The other end 32 of the duct 31 is coupled to a compressed air connection 33, fitted on the facing wall 34 of the core 27. A suitable pneumatic valve, for example a Schraeder valve, not shown, can retain air pressure within the duct 31, as well known. Such a valve can be fitted, for example, in the end portion 33 of the duct. The groove 29 has a tubular expansion ring element located therein, which is open with respect to the duct end 30.

In operation, compressed air is supplied to the duct 31, so that the expansion ring 35 will increase in the region of the surface of the core 27, towards the inner surface of the sleeve 28, and thus partially increase the diameter of the core 27 by the amount D3. This retains the printing sleeve 28 frictionally on the core 27, and the composite core 27 and sleeve 28 are sealed with respect to contaminants. As well known, the increase in the diameter D3 can be controlled by suitably controlling the pressure of the compressed air being admitted to the duct 31, as needed.

Figure 7:
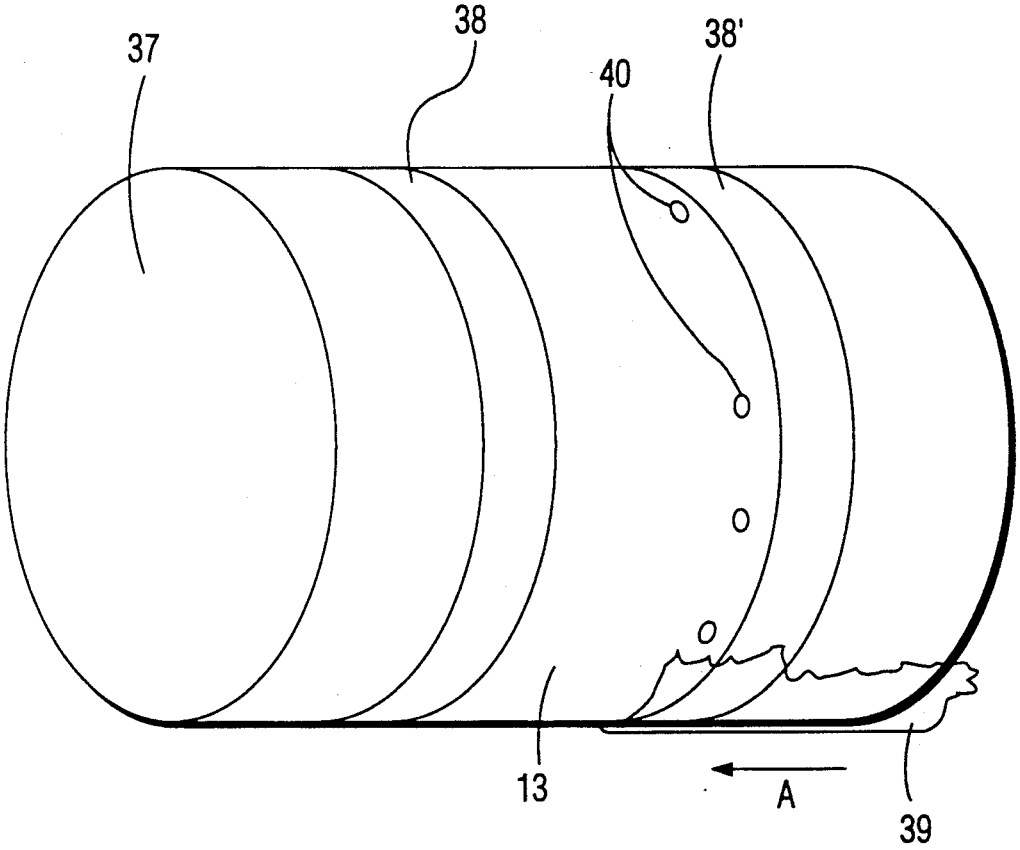
FIG. 7 is a pictorial representation, in highly schematic form and omitting portions not necessary for an understanding of the present invention of the cylinder core structure, upon application of a sleeve thereover.

FIG. 7, generally, shows the core structure 37, with two schematically shown grooves and expansion rings 38, 38' thereon. The figure is axially compressed. The region 13 is the printing zone, and corresponds to the printing zone of the cylinder 37.

In accordance with a feature of the present invention, and common to all the embodiments, the sleeve 39 is frictionally retained, and sealed with respect to the cylinder core 37 by only partial engagement of the expansion ring with the sleeve, so that the printing image in the printing zone is not degraded by expansion of the diameter of the cylinder 37 in the region of the grooves and rings 38,38', but the printing image is perfect in the region 13 between the expanded zones 38, 38'.

The present invention has the additional advantage that printing cylinders which have wall thicknesses of only 0.125 mm, and made of nickel, can be expanded by compressed air, emitted from openings 40—of which only a few are shown—formed in the core cylinder, so that they can be slipped on the core cylinder 37 over the resulting air cushion or air pillow. This relatively thin wall thickness and the relatively soft material of nickel of the sleeve ensure inherent sealing of the ring gap as the sleeve 39 is slid on the core, which gap occurs between the sleeve and the surface of the core. Thus, air can escape only in the direction of movement of the sleeve at the facing end or edge, and an air cushion will build up in the resulting ring gap. When using relatively thick-walled sleeves of aluminum and expanding them by compressed air, it has been found that a substantial amount of air introduced into the ring gap escapes in both directions from the facing ends of the cylinder. This is a problem in mounting the sleeves. Due to the substantial loss of compressed air, the resulting air cushion cannot be built up to a sufficient extent, so that assembling the sleeve over the core becomes difficult. The present invention permits, additionally sealing one end of the composite of the sleeve and the core with respect to pressure media, so that a suitable air cushion can be obtained, which facilitates assembly of a sleeve over the core and thus assembly of the final printing cylinder.

The sequence of re-sleeving a cylinder, thus, is this. A new cylinder 39 is fitted over the cylinder 37, and compressed air emitted from the openings 40 which, of course, are circumferentially located although only a few are shown in FIG. 7 for simplicity. After the sleeve 39 has been pushed in the direction of the arrow A beyond the openings 40, the expansion ring 38' is expanded to the extent that compressed air from the openings 40 can no longer escape in the axial direction, in FIG. 7 towards the right, over the right end portion of the cylinder from the openings 40, thus maintaining better control over the air cushion as the sleeve 39 is pushed over the core structure 37.

Various changes and modifications may be made, and any features disclosed and described herein may be used with any others, within the scope of the concept of the present invention.

Suitable dimensions D1, D2, D3 are: 0.2–0.5 mm.

I claim:

1. A composite sleeved printing machine roller or cylinder for a rotary printing machine having a cylinder core structure (2, 15, 27, 37) with a circumferential surface, and at least two grooves cut into said circumferential surface of said cylinder core structure;

a printing sleeve (3, 16, 28, 39) snugly surrounding said core structure and in engagement therewith, and being selectively removable therefrom or mountable thereover, and means for reliably fictionally seating said sleeve on the core structure for sealing said sleeve to the core structure to prevent ingress of contaminants between the sleeve and the core structure, and for compensating for differential thermal expansion of the sleeve and the core structure in operation of the printing machine, said seating means comprising, in accordance with the invention, means for clamping said sleeve (3, 16, 28) to the cylinder core structure (2)

comprising at least two expansion rings (12, 25, 35, 38, 38') located in said at least two grooves on said circumferential surface of the cylinder core structure (2, 15, 27, 37) and having an outer surface facing the inner surface of the sleeve (3, 16, 28), said expansion rings extending only in part across the axial length of the cylinder core structure and being located in the vicinity of the end faces of the cylinder core structure, thereby leaving an unexpanded intermediate portion (13) of the cylinder core between said expansion rings, and pressure providing means (5, 6; 17, 18; 31, 32; 35, 36) located within said cylinder core structure and selectively applying pressure between the expansion rings and the cylinder core structure to expand the expansion rings towards the inner surface of the sleeve (3, 16, 28) and clamp said sleeve on the cylinder core structure, wherein said pressure providing means expands said expansion rings to thereby increase the diameter of said cylinder core structure at the location of said at least two expansion rings without expanding the diameter of said unexpanded intermediate portion of said cylinder core structure, said printing or cylinder sleeve being in engagement with said intermediate portion of said cylinder core structure when said sleeve is clamped by the expansion of said expansion rings.

2. The roller or cylinder of claim 1, wherein said expansion rings (12, 35) comprise a plastic material.

3. The roller or cylinder of claim 1, wherein said plastic material comprises a thermoplastic material.

4. The roller or cylinder of claim 1, wherein said expansion rings comprise sheet-metal ring elements (25) welded to the surface of the cylinder core structure (15).

5. The roller or cylinder of claim 1, wherein said pressure providing means to deform the expansion rings (12, 25) comprises hydraulic means.

6. The roller or cylinder of claim 1, wherein said pressure providing means to deform the expansion rings (35) comprises pneumatic means.

7. The roller or cylinder of claim 1, wherein the degree of pressure applied by said pressure providing means is controllable.

8. The roller or cylinder of claim 5, wherein said pressure providing means comprises duct means (5, 6, 7; 17, 18) formed in said cylinder core structure;

said hydraulic means being retained within said duct means; and at least one screw element (10; 20) is provided, selectively changing the volume of said duct means retaining said hydraulic means.

9. The roller or cylinder of claim 6, wherein said pressure providing means comprises pneumatic duct means (30, 31) formed in said cylinder core structure (27); and a compressed air connection (33) coupled to said pneumatic duct means.

10. The roller or cylinder of claim 1, wherein said grooves are formed with undercut edge regions (4'), and the expansion rings are fitted within the undercut regions.

11. The roller or cylinder of claim 1, wherein the expansion rings (25) are welded to edge regions of said groove.

12. The roller or cylinder of claim 1, wherein the expansion ring (35) comprises a flexible, expansible tube fitted within said groove, and pneumatically coupled to said pressure providing means (30, 31, 32, 33).

13. A method to apply a circumferentially continuous printing sleeve (3, 16, 28, 39) over a cylinder core structure (2, 15, 27, 37) comprising the steps of:

providing a printing cylinder core structure including means for expanding a diameter of the cylinder core structure in at least two locations in the vicinity of axial end portions of the core structure, while leaving the diameter of the core structure between said enlarging means unexpanded, said unexpanded portion of said core structure defining a printing zone (13), and including unexpanded control ducts (6, 17, 31) for expanding said expanding means, said core cylinder structure being formed with surface openings (40), emitting compressed air radially outward of said surface openings while sliding a printing sleeve over said surface openings and said enlarging means on said core structure.

after the sleeve has been fitted over and beyond one of said expanding means, expanding one of said expanding means (38') only to an amount to prevent escape of compressed air from said openings axially of the core structure in the direction of the expanded expanding means (38') and to still allow the sleeve to be slipped over said core structure until the sleeve is positioned correctly on said core structure and said expanding means.

* * * * *